US007694362B2

(12) United States Patent
Gudipati

(10) Patent No.: US 7,694,362 B2
(45) Date of Patent: Apr. 13, 2010

(54) SUPPORT FOR BABY

(76) Inventor: Ramachandra Rao Gudipati, 7/22 Priddle Street, Westmead, New South Wales (AU) 2145

( * ) Notice: Subject to any disclaimer, the term of this patent is extended or adjusted under 35 U.S.C. 154(b) by 27 days.

(21) Appl. No.: 11/593,748

(22) Filed: Nov. 7, 2006

(65) Prior Publication Data

US 2007/0067908 A1 Mar. 29, 2007

Related U.S. Application Data

(63) Continuation-in-part of application No. PCT/AU2005/000658, filed on May 9, 2005.

(30) Foreign Application Priority Data

| | | |
|---|---|---|
| May 7, 2004 | (AU) | 2004902434 |
| Nov. 9, 2004 | (AU) | 2004906432 |
| Mar. 16, 2005 | (AU) | 2005901279 |

(51) Int. Cl.
*A47D 9/02* (2006.01)

(52) U.S. Cl. ..... 5/109; 5/101; 5/609

(58) Field of Classification Search ..... 5/93.2, 5/100, 109, 609, 424, 946, 101
See application file for complete search history.

(56) References Cited

U.S. PATENT DOCUMENTS

| | | | | |
|---|---|---|---|---|
| 3,748,666 | A * | 7/1973 | Seng | 5/609 |
| 3,862,454 | A * | 1/1975 | Mazzucconi | 5/47 |
| 5,228,155 | A * | 7/1993 | Shultz et al. | 5/109 |
| 5,324,064 | A | 6/1994 | Sumser et al. | |
| 5,502,853 | A * | 4/1996 | Singleton et al. | 5/609 |
| 5,553,337 | A * | 9/1996 | Lin | 5/93.2 |
| 5,960,493 | A * | 10/1999 | Rhey et al. | 5/424 |
| 6,112,748 | A | 9/2000 | Esdale et al. | |
| 6,971,127 | B2 * | 12/2005 | Richards | 5/108 |

FOREIGN PATENT DOCUMENTS

| | | |
|---|---|---|
| NL | 1015897 | 2/2002 |
| NL | 1015897 | 4/2002 |
| NL | 1023271 | 10/2004 |
| NL | 1023271 | 1/2005 |
| WO | WO 95/11607 | 5/1995 |

* cited by examiner

*Primary Examiner*—Fredrick Conley
(74) *Attorney, Agent, or Firm*—King & Schickli, PLLC

(57) ABSTRACT

According to one aspect of the present invention there is provided a support assembly for supporting a baby, the support assembly including: a support element on which a baby is supported in use; a chassis operatively connected to the support element, the chassis including adjusting means to provide adjustment to both the height and attitude of the support element relative to the chassis.

20 Claims, 15 Drawing Sheets

SUPPORT FOR BABY

CROSS REFERENCE TO RELATED CO-PENDING APPLICATION

This application is a continuation-in-part of international PCT application number PCT/AU2005/000658 (publication number: WO 2005/107533 A1) filed on May 9, 2005, and entitled SUPPORT FOR BABY, which claims priority to Australian patent application number 2004902434 filed on May 7, 2004, Australian patent application number 2004906432 filed on Nov. 9, 2004, and Australian patent application number 2005901279 filed on Mar. 16, 2005, the contents of which are all expressly incorporated herein by reference.

FIELD OF THE INVENTION

The present invention relates generally to supports for supporting a baby, in some applications during breastfeeding, settling, nappy changing, dressing and general playtime.

BACKGROUND TO THE INVENTION

It is commonplace for breastfeeding women or other carers to hold a baby in their arms while breast- or bottle-feeding the baby. During this procedure, they carry the baby over a period of 10-30 minutes in their arms. The number of times they do that per day will depend upon the age and size of the baby, but it may be 4-8 times a day, and this may be for the first 3-24 months of the child's life.

Furthermore, there is additional time spent carrying the baby while attempting to settle them sufficiently so that they can sleep. These prolonged periods of carrying a baby to feed and/or settle, especially after a pregnancy of nine months can create a lot of stress on the back, neck and arms of a carer's body. Carers may end up having back pains, upper back pain, neck pains and the like.

The present invention seeks to ameliorate one or more of the abovementioned disadvantages.

SUMMARY OF THE INVENTION

According to one aspect of the present invention there is provided a support assembly for supporting a baby, the support assembly including: a support element on which a baby is supported in use; a chassis operatively connected to the support element, the chassis including adjusting means to provide adjustment to both the height and attitude of the support element relative to the chassis.

The chassis may take any suitable form such as a central post with stabilizing, ground-engaging spokes at its base, however, in preferred embodiments, the chassis includes at least two spaced-apart pillars or legs and in one preferred embodiment, there are four pillars or legs, one at each vertex of a rectangle.

Also, the adjusting means may take any suitable form, such as for example, a central pivot such as a ball-and-socket joint atop a central post. However, in preferred forms, the adjusting means includes one or more guide means and corresponding or cooperating followers. The guides are preferably in the form of a guide roller and operatively connected to the chassis. The followers are connected to the support element so that the support element changes its attitude directly in response to that of the followers. In preferred forms four guide rollers are provided, each generally adjacent one of the four comer pillars, each follower having a curved track aperture therein.

In operation, the guide roller runs in the aperture and inhibits the follower's movement to the arcuate path set by the track aperture.

Furthermore, the adjusting means may include adjustable stands for extending or retracting the height of the chassis. In one form a link means is provided between one or more pillars in order to provide uniform adjustment across at least one pair of adjacent pillars for the support element.

In one preferred form of the invention, adjustment for the adjustable stands is provided by aligned apertures in the pillars and stands. A locking pin extends through the apertures and locks the stands and pillars together. The apertures may be elongate or discrete, round holes. The pin may include an enlarged head or heads which draw the stands and pillars together so that the head or heads hold adjacent or abutting faces of the pillars and stands together by friction. In other embodiments, the pin may simply pass through two aligned holes so that the pillar and stand are inhibited from moving relative to each other.

The adjustable stands may include a ratchet that provides detents so that the or each stand may stop at discrete positions along each respective pillar. The ratchet allows extension in increments but inhibits retraction without operation of an actuator.

Height extension or attitude adjustment may be accomplished by mechanical, hydraulic, pneumatic or electrical means, or a combination of one or more of the abovementioned means. In one preferred form, the guides are moved along their respective followers by electrical motor and rocking means. In this embodiment, a motor drives the rocking means which includes, from the motor end, a crankshaft which is then connected at its end to one end of a conrod. The conrod is connected at its other end to an edge of the support element, and that edge is essentially reciprocated in direct response to the conrod's reciprocating movement when the motor is in operation. The support element, when the motor is in operation, pivots about the centre of the arcuate track.

A disengaging means may be provided to disengage the electric motor, crankshaft, or conrod from the support element or chassis, in order to allow the rocking motion to be imparted manually. When the rocking motion is imparted either automatically or manually, the child is still in close proximity to the carer, to soothe the child.

In another embodiment of the present invention, the rocking means includes a rack-and-pinion mechanism. The rack-and-pinion includes a rotating pinion connected to the motor shaft, and a rack channel including a rack mounted on opposing, spaced apart, peripheral interior walls. The rotating pinion only includes teeth on part of its outer periphery. In this manner the rack channel is engaged to be driven one way by engagement with the pinion on one wall of the channel, and thereafter the pinion releases the rack on that wall, and then its teeth engage the rack on the other wall, driving the rack channel and the operatively connected support element in the other direction.

Preferably, a restraint device is provided on the support element to hold the child while a carer is getting ready to feed or play or change the child's clothes. In one form the restraint device is a multi-point harness including crotch, waist and shoulder restraint belts.

Advantageously, preferred embodiments of the present invention provide assistance to carers in alleviating the necessity to carry a child in their arms when they want to breastfeed or bottle feed. Furthermore, preferred embodiments of the present invention enable carers to be able to have babies close to their bodies, to share warmth and love, while breast- or bottle-feeding.

In addition, preferred embodiments of the present invention promote the transfer of substantially all of a baby's load to the support element, making breast- or bottle-feeding a lower-stress activity for a carer. The adjustable height enables carers of different height to be able to adjust the product to their convenience. The tilting support element allows for positioning a baby's head higher than its stomach to facilitate easy intake of milk and to reduce the chances of milk settling in the oesophageal passage and creating discomfort for the baby.

The support element may include a padded table having a single platform, or a plurality of articulated or folding platforms, or may include a hammock chair. In one preferred embodiment, the padded table is removable and is disposed, when installed, on a hammock bed. A transverse strut is mounted in a mounting at an intermediate location on the chassis so as to provide support for the padded table when installed. The strut may be removed from the mounting so as to facilitate location of a hammock support for a child. A second mounting for the strut may be provided so as to provide a seat for the child as it grows. The second mounting is disposed closer to one end, so that, when the strut is installed, a form of bucket seat is provided.

Advantageously, preferred embodiments of the present invention enable carers to breast- or bottle-feed while the carer is seated either on a lounge, bed or floor.

Sound amplification, output and input means may be provided so as to play music or white noise if it is required to soothe the child.

The support element may also take the form of a tabletop to enable its use for other purposes such as a study desk or surface.

Locking means may also be provided on the adjustment means in order to lock the support element in a selected attitude relative to the chassis.

In one embodiment the chassis includes a sub-frame to support the support element, the sub-frame including edge mounts in the form of spaced-apart support brackets each mounted on opposing faces of the guides. In this embodiment, at least one bracket is adapted to lower at least one respective edge of the support element by being pivotally mounted to the guides. This lowering of the edge of the support element is useful in providing a more upright sitting position for the baby, wherein the baby's feet would be generally adjacent the lowered edge, and the head would be relatively higher than the feet.

BRIEF DESCRIPTION OF THE DRAWINGS

In order to enable a clearer understanding, the invention will hereinafter be described with reference to drawings and description of preferred embodiments. In the drawings.

Reference will now be made in detail to the present preferred embodiment of the invention, an example of which is illustrated in the accompanying drawings.

DETAILED DESCRIPTION OF THE PREFERRED EMBODIMENTS

Figure 1:
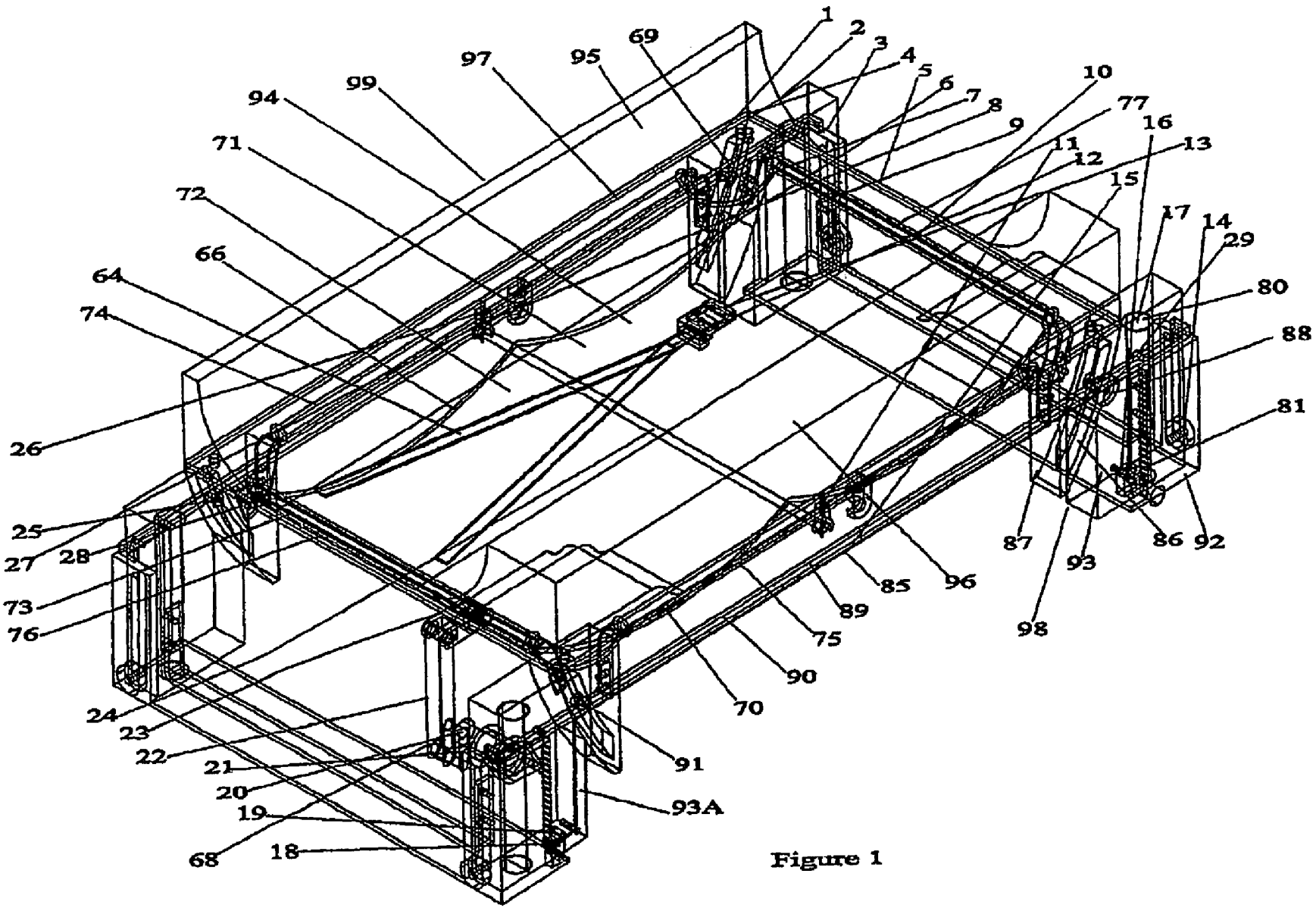
FIG. 1 is an isometric view, from above and to one side, of a support assembly according to a first example embodiment of the present invention.

Referring to FIG. 1 there is shown a support assembly for a baby generally indicated at 99 which includes a first support element 97 operatively connected to a chassis 98. The first support element 97 is in the form of a flat bed 4 which includes retaining devices 96 in the form of walls 95 which are in turn in the form of contoured foam pillows 6. At least one of the contoured foam pillows 6 is removable so that the baby supported on the support element 97 may access an edge of the support element 97 for breast- or bottle-feeding and for touch contact with a carer (not shown). Cushioning means 94 are provided on the flat bed 4 so as to increase comfort for the baby (not shown) when mounted in the support assembly 99. The cushioning means 94 are in the form of a contoured foam mat 5.

The chassis 98 includes four spaced-apart pillars 93. The chassis 98 also includes stands 92 which, when activated, elevate the pillars 93 in order to adjust the height of the support element 97 to a desired height. A raising mechanism 81 is provided in the form of a ratchet mechanism 91, itself including ratchets 16 and 18 which are disposed on adjacent pillars 93 and 93A respectively. The ratchets 16 and 18 are connected by a connector 90 in the form of a wire 15 so as to operate the ratchets 16 and 18 in unison. In operation, a ratchet handle associated with ratchet 16 is actuated, which draws on the wire 15, and pawl or ratchet lock associated with ratchet 18 is withdrawn from the ratchet track, and the stands may then allow a new height to be selected. The stands include automatic extension means 80 in the form of springs 17 which act between the stands and the pillars. The springs 17 allow automatic extension upwards once the pawl has been released. Other means of automatic extension contemplated include electric motor drive for a rack and pinion device, and hydraulic or pneumatic extension.

Figure 2:
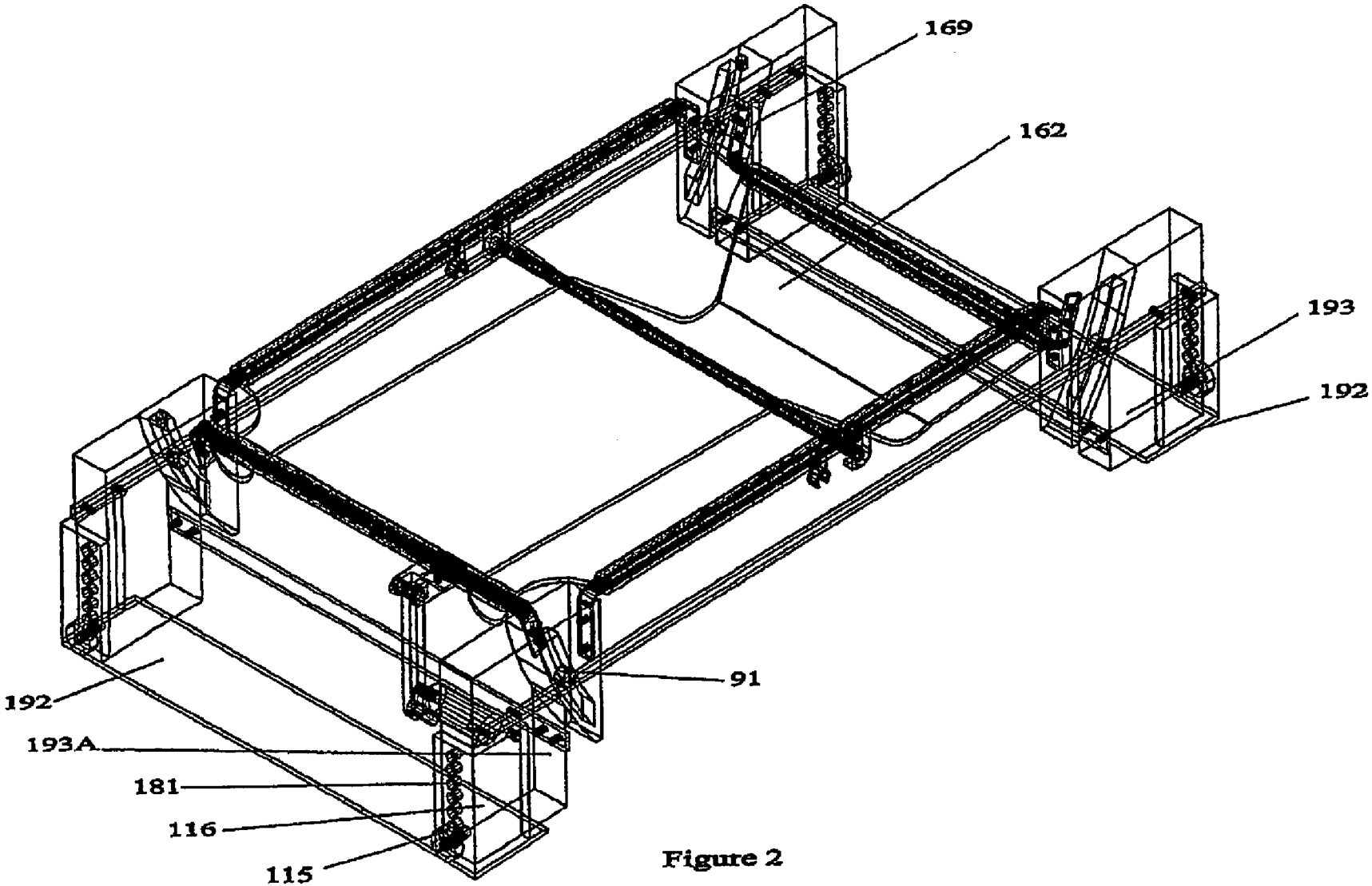
FIG. 2 is a similar view to that shown in FIG. 1, with a support element removed for clarity, and a second support element in a seated hammock position.
Figure 3:
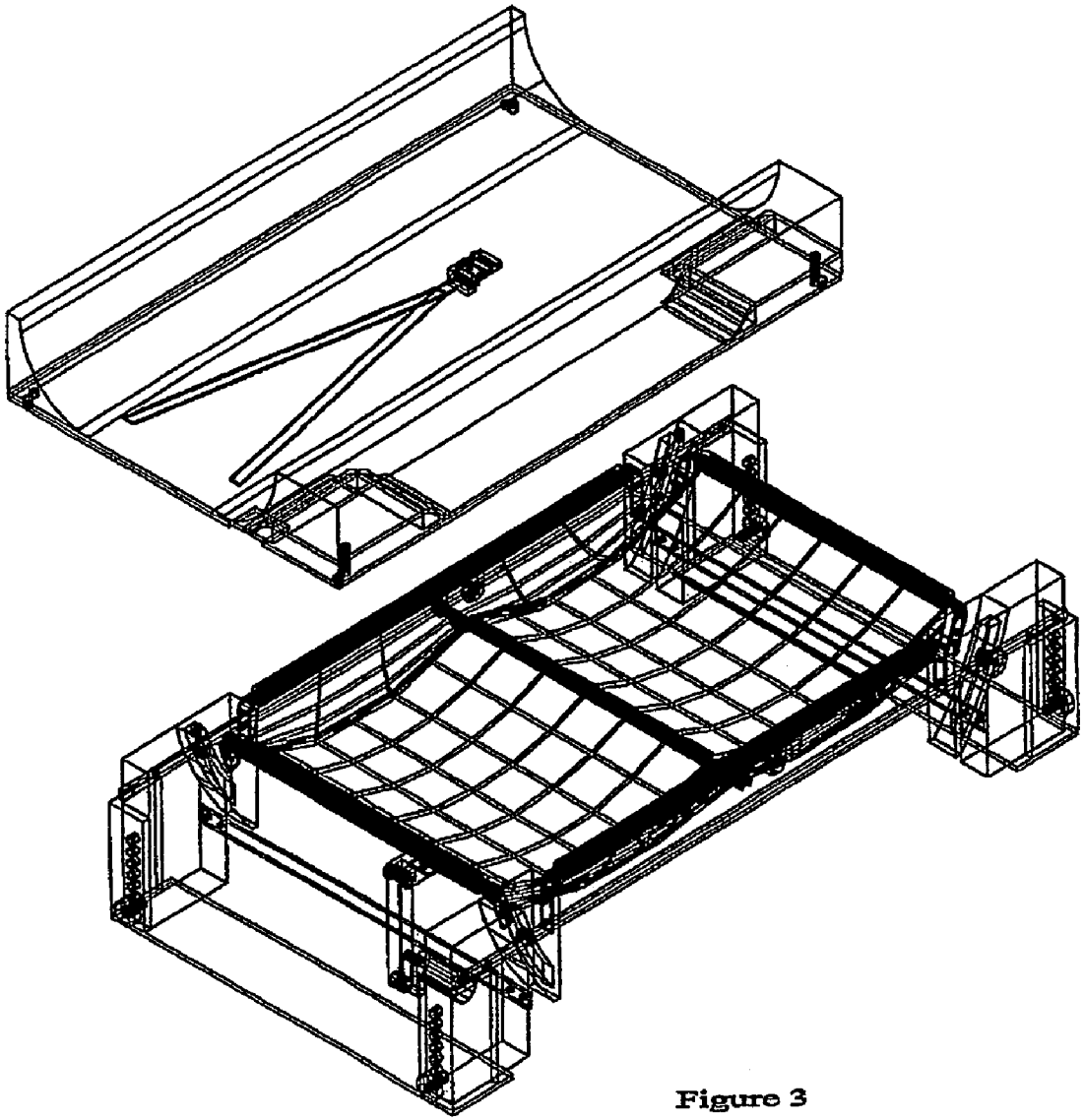
FIG. 3 is a similar view to that shown in FIGS. 1 and 2, partially exploded to show parts below a support element.
Figure 4:
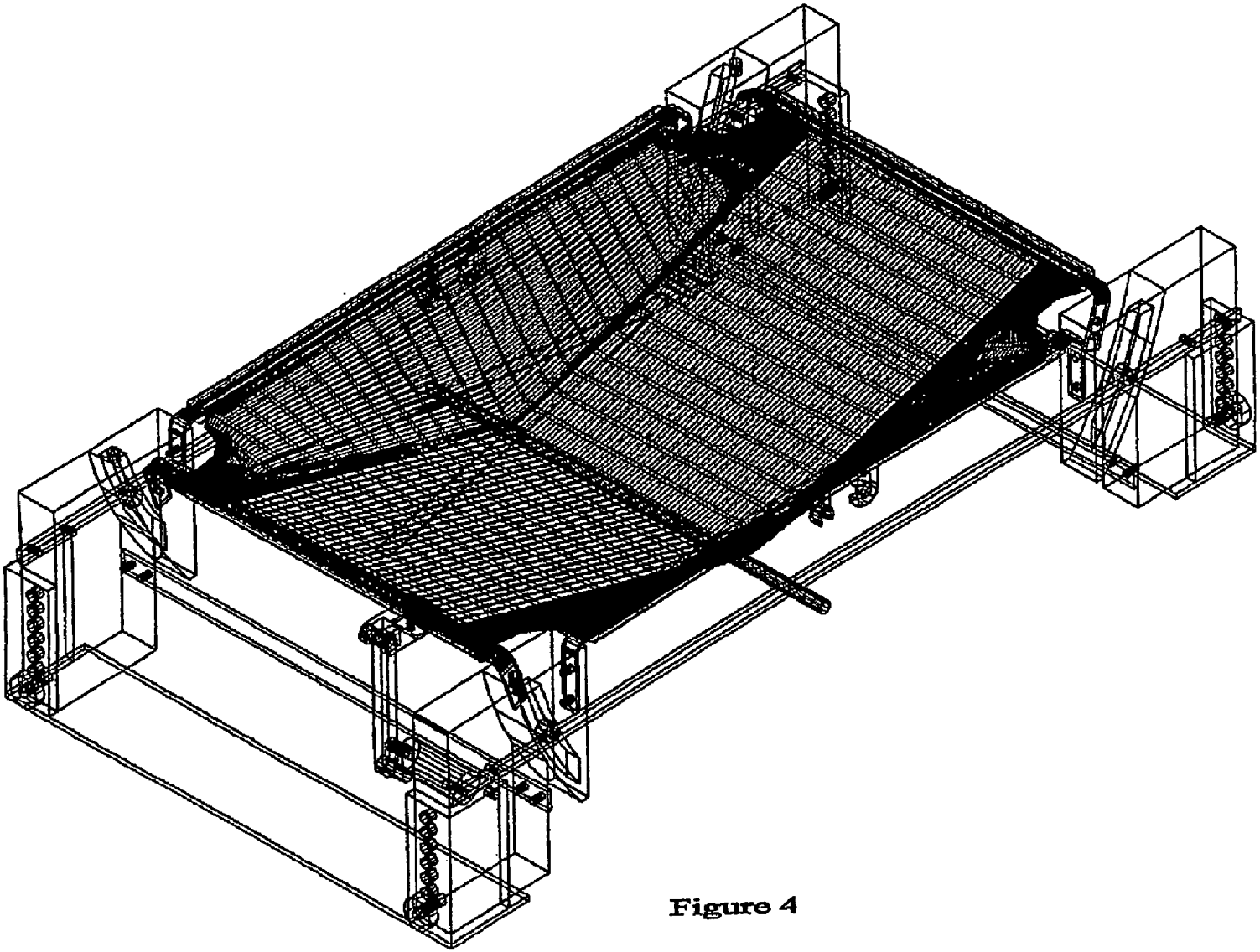
FIG. 4 is a similar view to those shown in FIGS. 1-3, with the support element shown in a lying hammock position.
Figure 5:
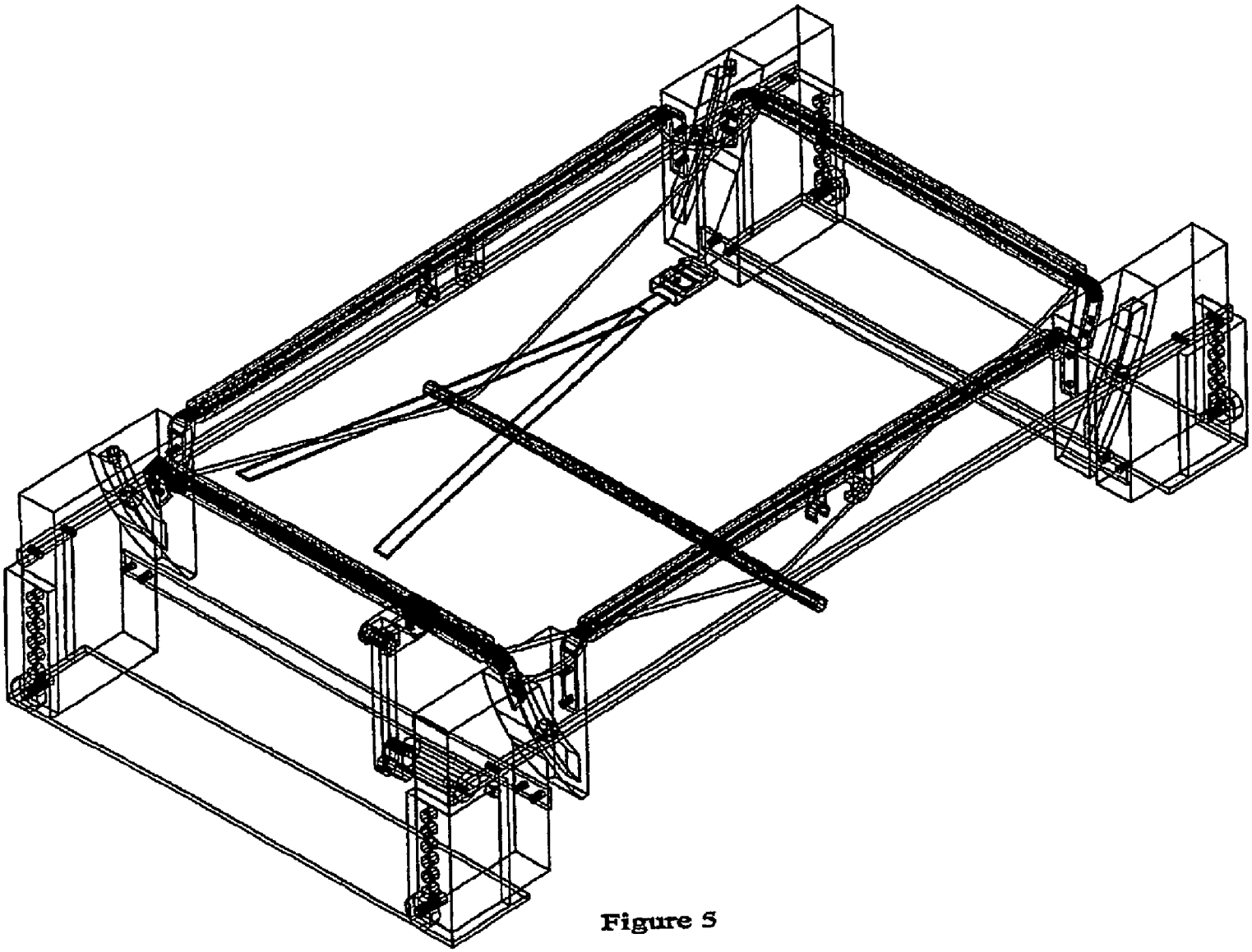
FIG. 5 is a similar view and assembly setup to that shown in FIG. 4.

Considering FIG. 2 for this paragraph, in relation to stands 192, the raising mechanism 181 includes a plurality of apertures 116 which must be aligned for receiving a pin 115 which locks the stand 192 and pillar 193 together when the desired height has been selected.

Returning to FIG. 1, the chassis 98 further includes guide means 91 in the form of guide rollers 25, which are pivotally mounted on mounting brackets 90 in the form of elongate bars 89 in turn mounted at their ends on pillars 93. Cooperating followers 1 are provided in the form of following blocks 87 which include respective following curved apertures 86 for receiving a respective guide roller 25. The support element 97 is connected to the followers 1 and the arrangement is such that each guide roller 25 cooperates to constrain movement of support element 97 to that defined by the aperture.

A rocking lock 88 is provided in the form of a screw-in mechanism so that a screw fastener 29 inhibits relative movement between follower 1 and chassis bar or chassis rail 89. In one form, internal walls of the curved aperture 86 are threaded so as to receive the screw fastener.

Figure 6:
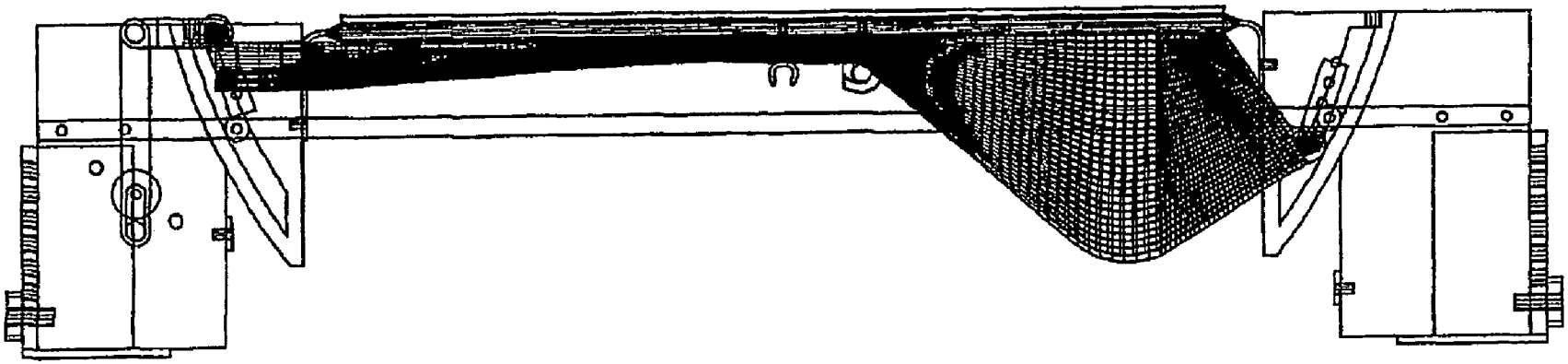
FIG. 6 is a side elevation view of FIG. 2.
Figure 7:
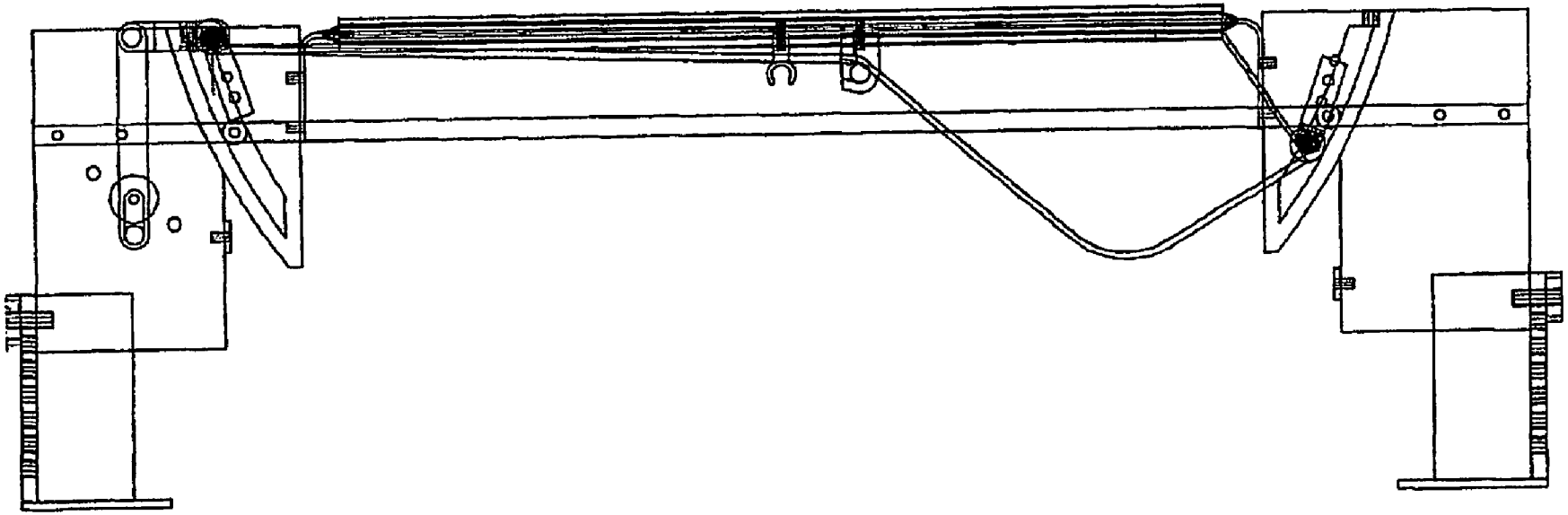
FIG. 7 is a side elevation view of FIG. 2, with the height raised to suit taller carers.

A support sub-frame 70 is provided which supports a second support element 71 in the form of a hammock bed 72 having a flexible sheet hammock element 66. The sub-frame 70 includes support arms 73 in the form of spaced-apart brackets 74, 75, 76 and 77. The brackets 73 are generally elongate brackets mounted at their ends to opposing faces of following blocks 87. The brackets 73 have turned-up ends to provide offset, easier mounting and additional strength. Bracket 77 is adapted to be pivoted about its offset mounting so that it can be swung downwards to provide a more upright position for a child to lie or sit in while installed in the hammock 72. This position is shown in FIGS. 2, 6 and 7, while the bracket 77 is shown in an upper position in FIGS. 1, 3, 4 and 5. A fastener 69 is provided which has a smooth periphery at least across part of its shaft so that the bracket 77 may be more easily pivoted about this fastener.

The support elements 97 and 71 are mounted so that their attitudes may be changed by moving the following blocks 1 relative to the guide means 91. Reciprocating motion of the following blocks 1 relative to the guide means 91 promotes a rocking motion about the centre of the curved apertures, which is often soothing for the baby. Reciprocating motion may be imparted manually or automatically. Automatic motion is provided by an automatic rocking assembly 68 including an electric motor 20 having an output operatively connected to a crankshaft 21, itself connected at one end to one end of a conrod 22. The conrod 22 is directly or indirectly (via bracket 23) pivotally connected at its other end to bracket 76.

A restraint 12 assembly is provided which includes shoulder straps 64 and a clasp 13 which connects to the support element 97 or 71. In this arrangement, a hybrid system is provided which gives crotch restraint and shoulder restraint, so that the child is inhibited from moving downwards and upwards and sideways in the plane of the support element 97 or 71.

A keeper 24 is provided which holds the flexible sheet hammock element 66 upwards and away from the legs of a carer which, during feeding operation, extend underneath the support elements 97 and 71. The keeper 24 may be mounted in mounts 11 which are fixed to bracket 75 and 74 in an intermediate position along each respective bracket. The keeper 24 may be sewn or otherwise fixed to an underside of the flexible hammock element 66 so that it is less likely to be misplaced. The keeper can drop out of the mounts and thus out of the way when the child is required to lie or sleep in the hammock 72.

Retainer blocks 27 are provided, mounted to brackets 75 and 74 at a position closer to bracket 77 than mounts 11. The retainer blocks 27 retain keeper 24 as shown in FIGS. 2, 6 and 7. When the keeper 24 is mounted in the retainer blocks 27, a seat 162 (FIG. 2) is provided so that the child (not shown) may sit more upright while in the support assembly. To provide a more upright seating arrangement, see previous description of drop-down bracket 77.

The conrod 22 may be disengaged from the crankshaft 21, however, it may only be engaged or disengaged if the support element 97 or 71 is at least horizontal and/or sub-frame bracket 76 is higher than bracket 77. This is provided by the length of the crankshaft and conrod to ensure that the baby's head is not placed under its feet.

In one embodiment, the support element 97 can be extended to "wrap" around the carer to form a recess or U-shaped support element for support of elbows or baby's legs and arms.

Figure 8:
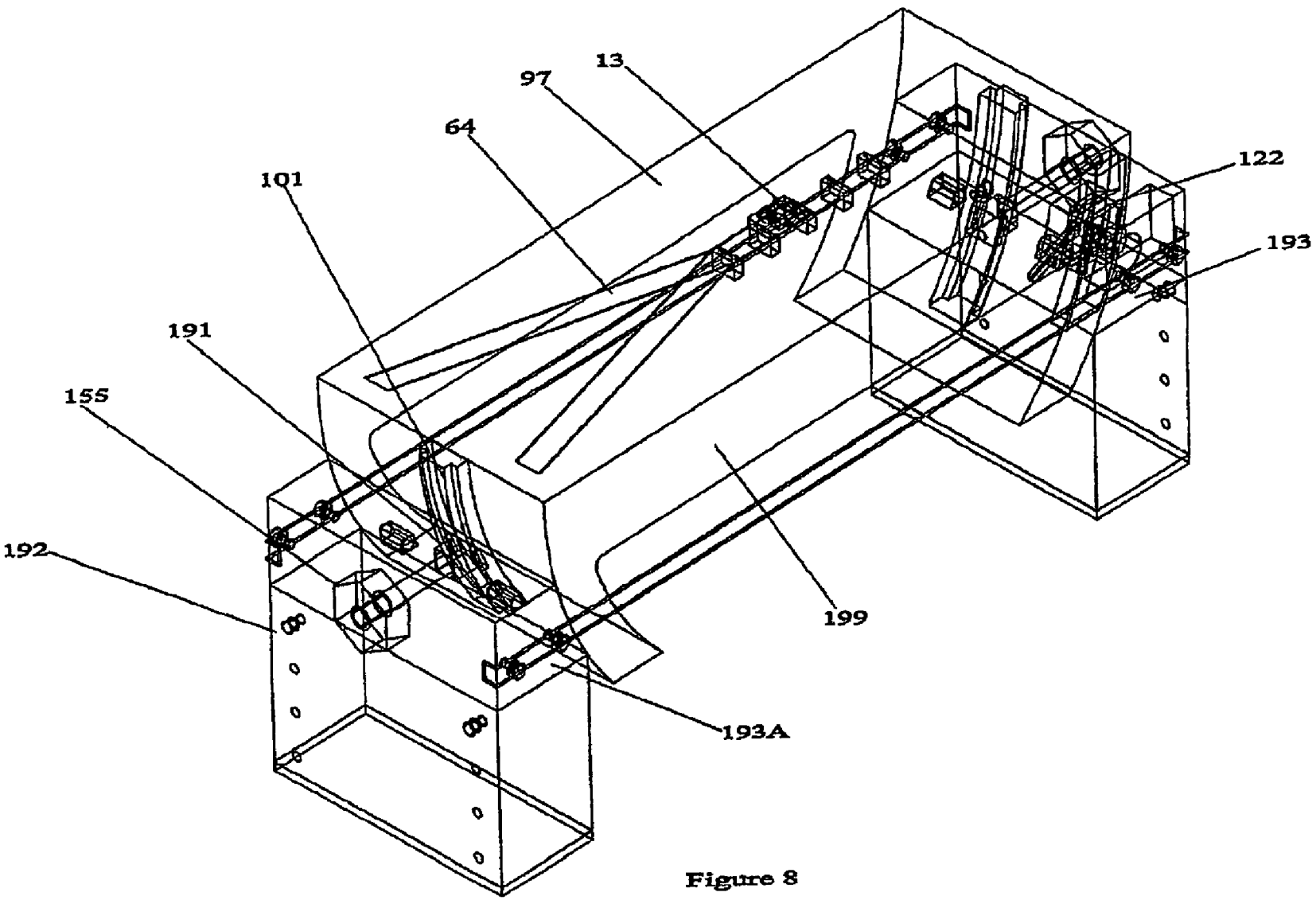
FIG. 8 is an isometric view, from above and to one side, of a second example embodiment of the present invention.
Figure 9:
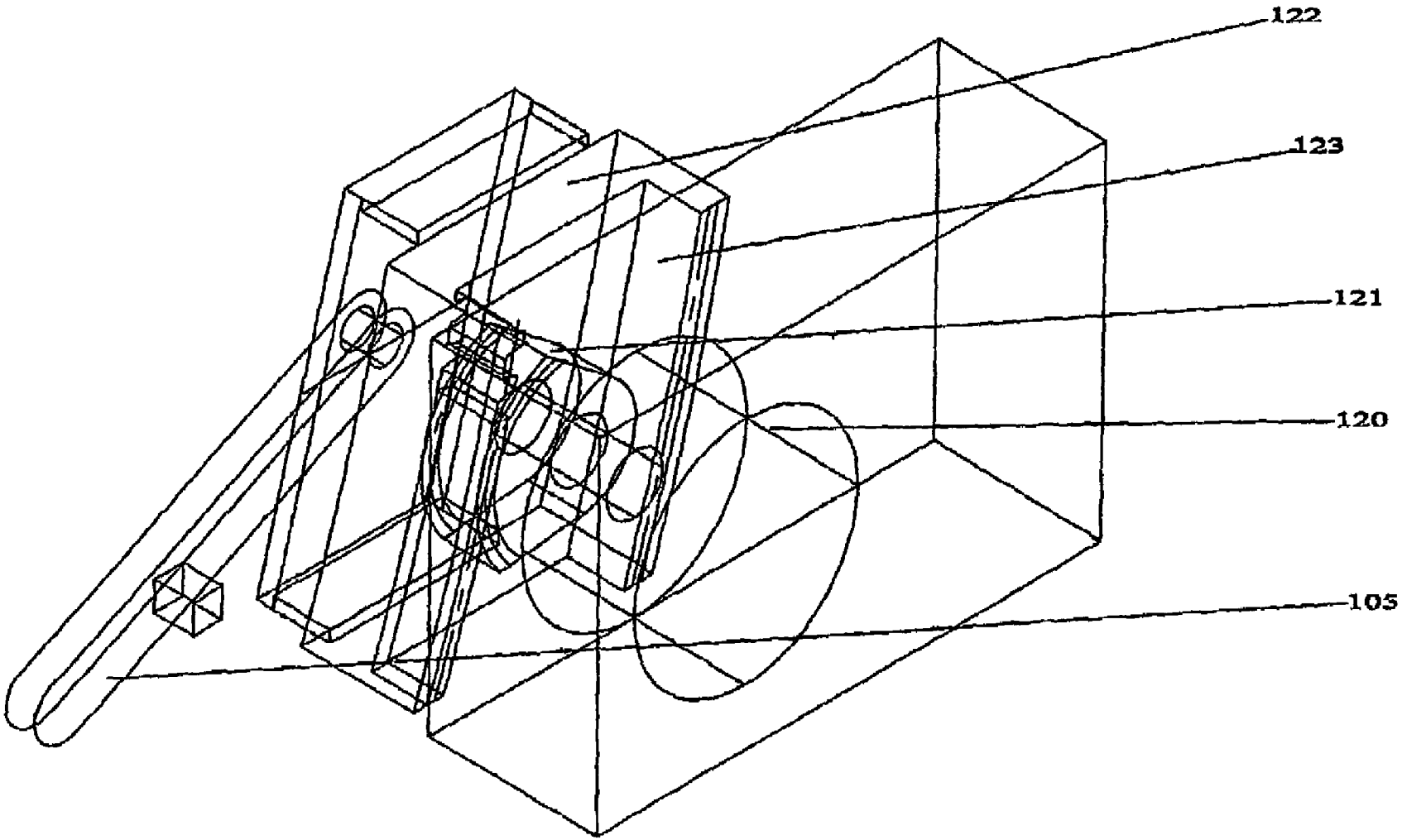
FIG. 9 is a detail isometric view of FIG. 8 which shows a rack and pinion rocking mechanism with a motor and disengagement device.
Figure 10:
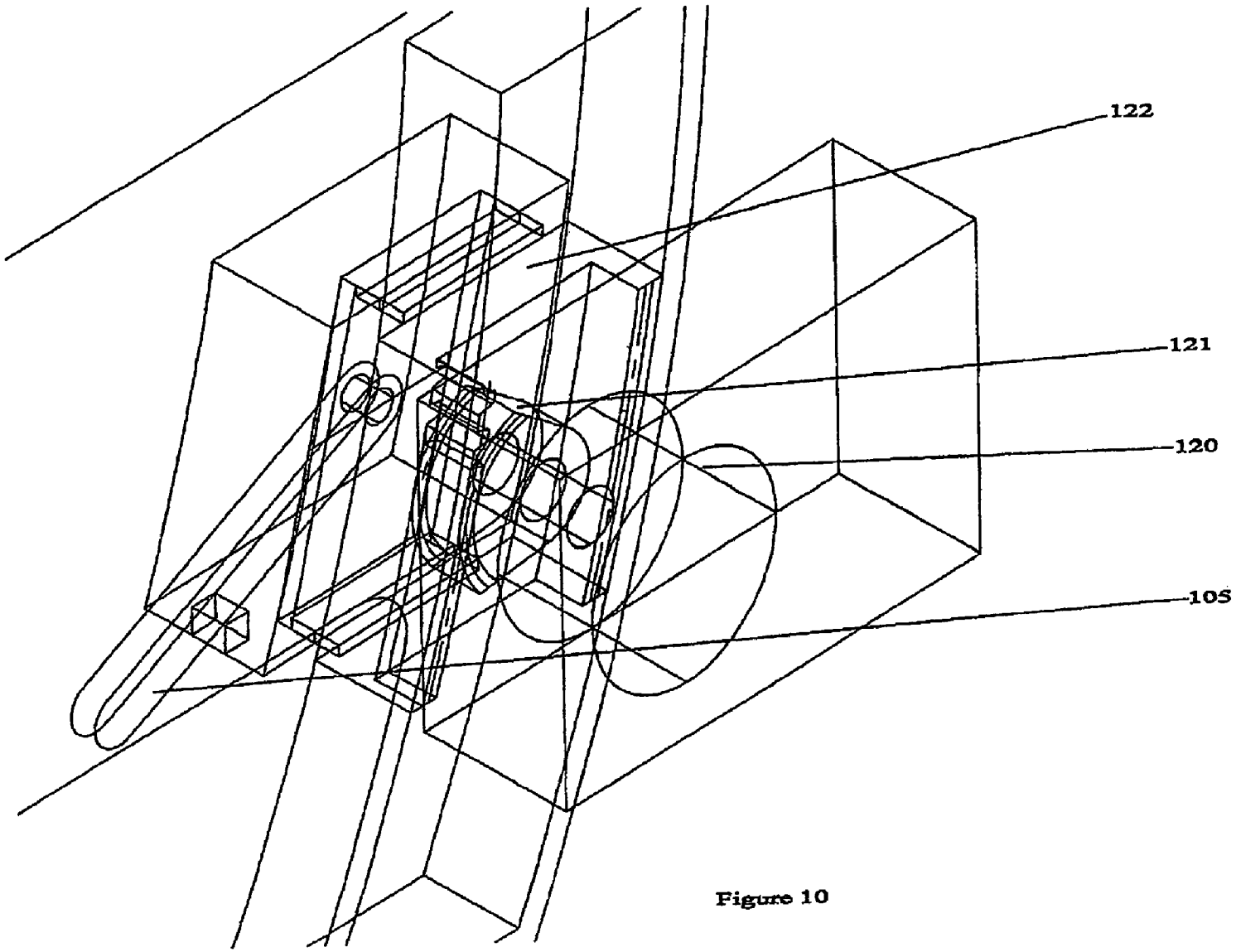
FIG. 10 is a further magnified view of FIG. 9.
Figure 11:
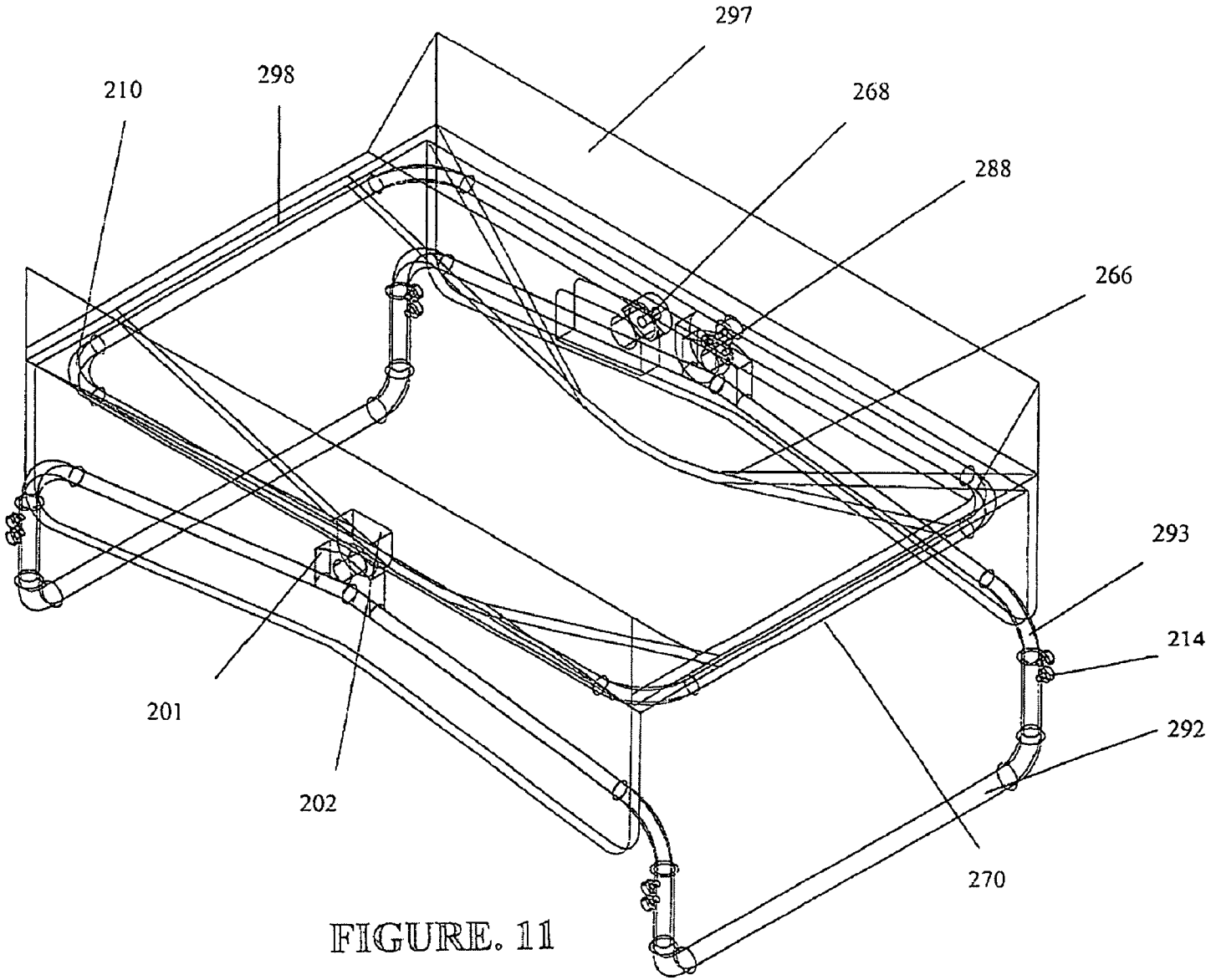
FIG. 11 is an isometric view of a third example embodiment of the present invention.
Figure 12:
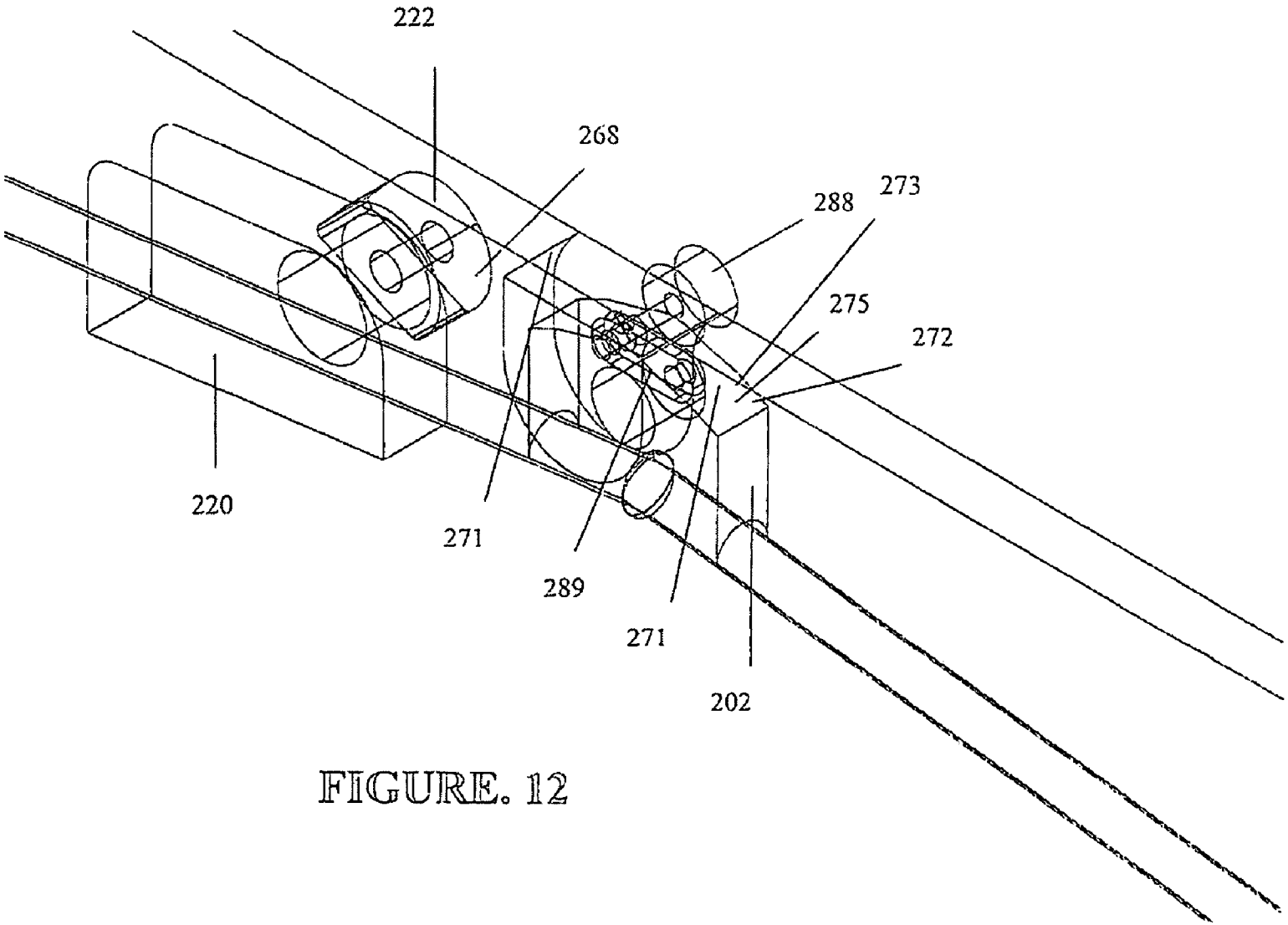
FIG. 12 is an isometric detail view of a rocking mechanism and lock associated with the third embodiment shown in FIG. 11.
Figure 13:
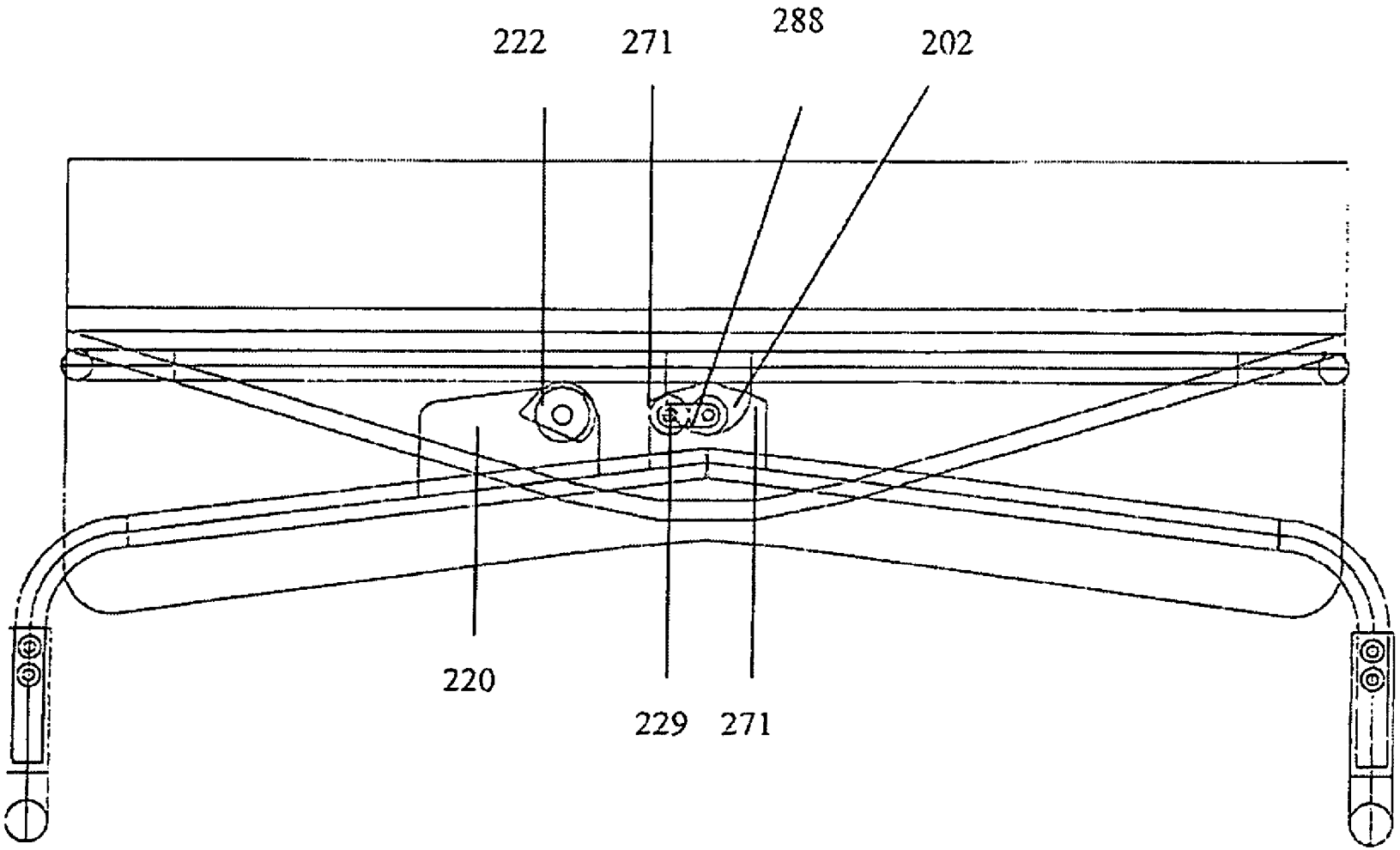
FIG. 13 is a side elevation view of the third embodiment shown at FIG. 11.
Figure 14:
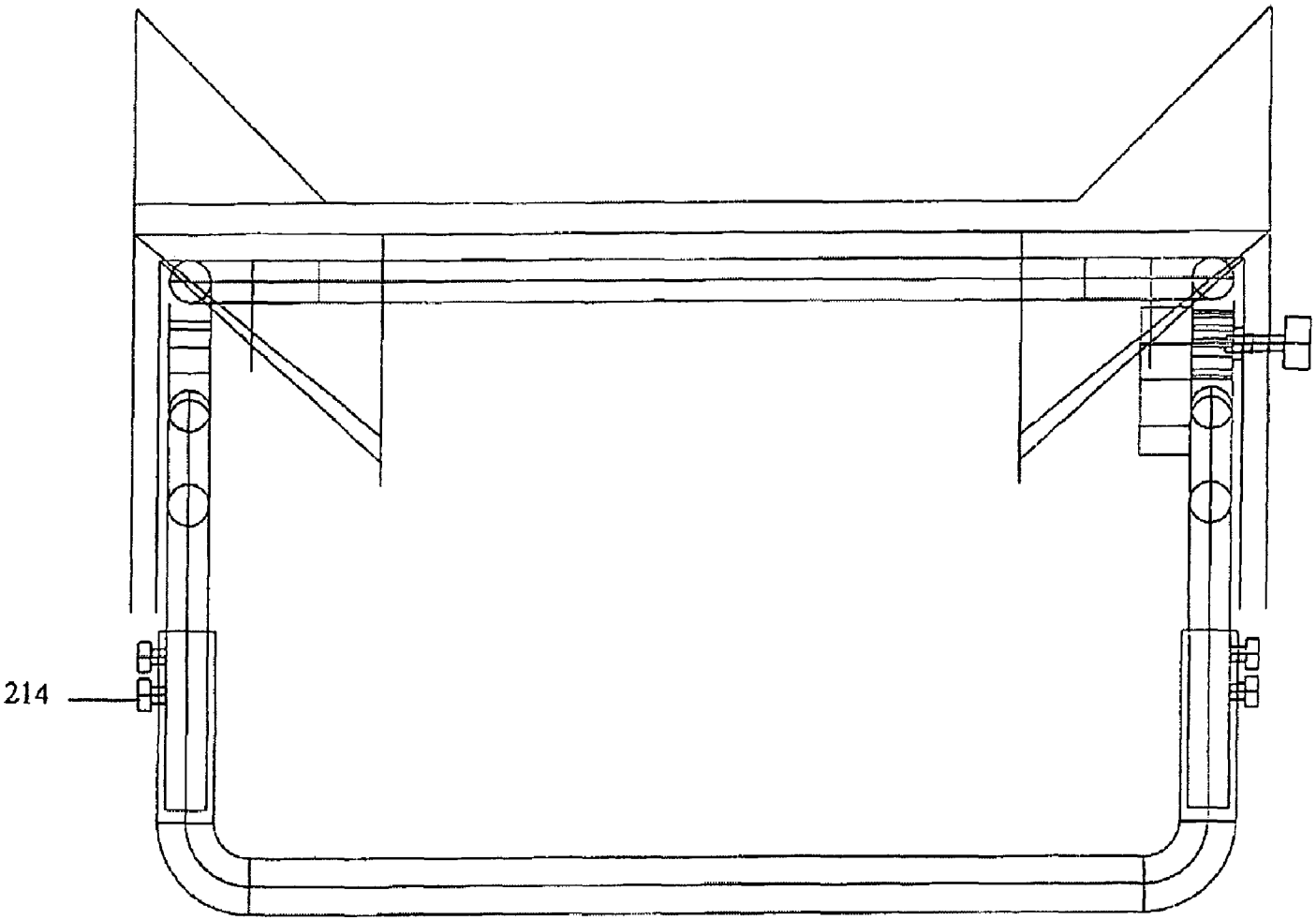
FIG. 14 is an end elevation view of the third embodiment shown at FIG. 11.
Figure 15:
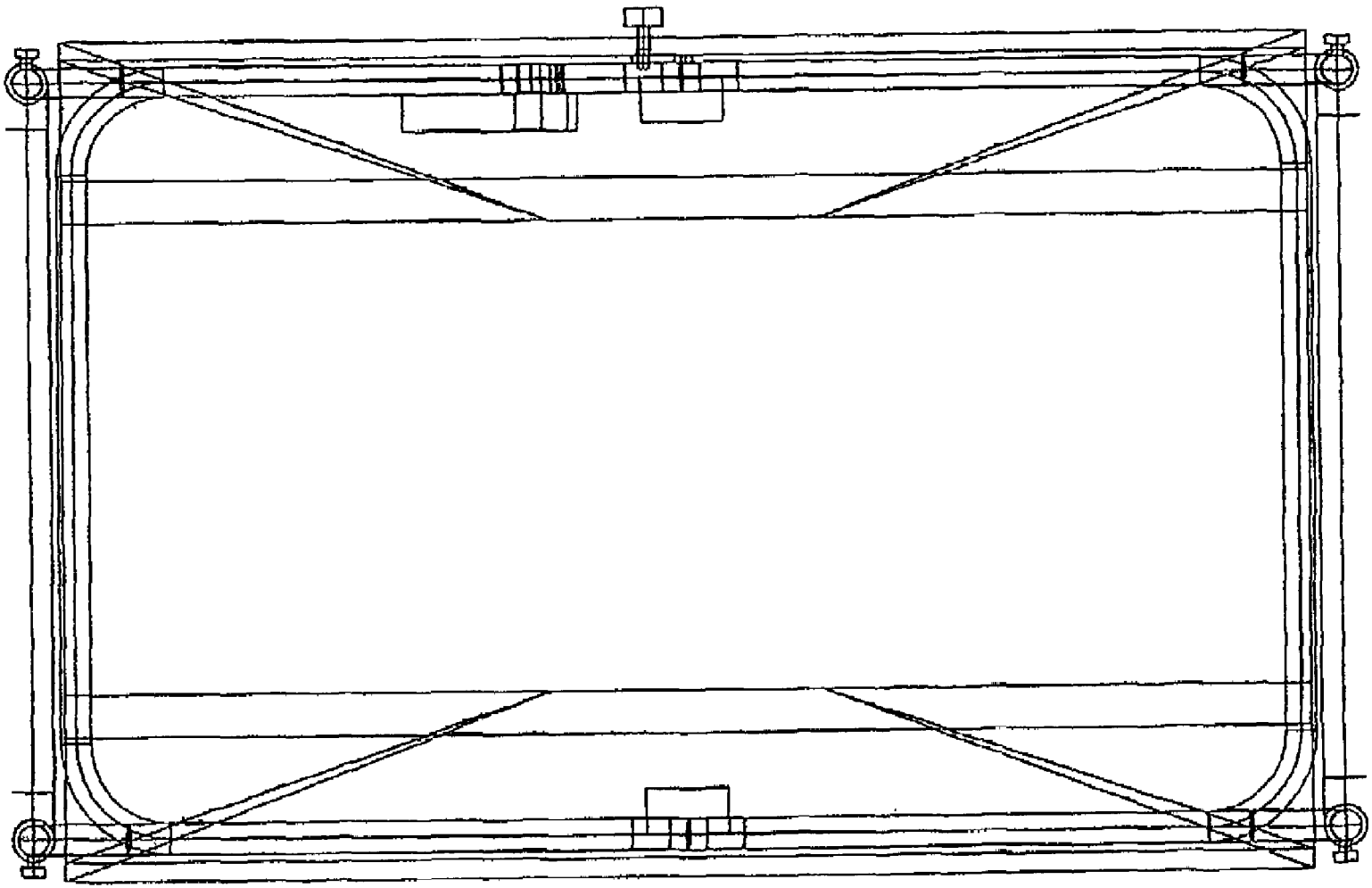
FIG. 15 is a plan view of the third embodiment shown at FIG. 11.

FIGS. 8 to 10 show another embodiment of device which has two spaced-apart pillars 193 and 193A. A major difference between the embodiments in FIGS. 1 and 8 is that in FIG. 8 the rocking motion is imparted by an electric motor 120 which drives a pinion 121 which engages with a rack 122. The rack 122 is in the form of a channel which includes opposed walls having racks 123 incorporated therein. An engagement handle 105 is also provided.

A biasing mechanism may be provided so that the motor may not need to work to return the rocker. However, in the embodiment shown in FIGS. 8-10, the pinion 121 only has teeth on a portion or a sector thereof. This allows teeth of pinion 121 to engage one rack wall of the channel to move the rack in one direction. The teeth disengage one wall and then, as the pinion 121 continues to rotate, the teeth engage the other wall so as to return the rack channel to its original position.

Amplifiers, music input devices, and output devices may be provided to soothe the baby to sleep. White noise generators are also suitable for this purpose. Bottle supports for supporting bottles may be also provided.

Safety guards and bumpers may be provided where necessary to increase the safety of the product, for example, around the crankshaft and rack-and-pinion mechanism to ensure that fingers are not caught.

The shapes of the contoured foam can be changed to as desired to accommodate standards and ergonomics.

In operation, the height is adjusted to suit the carer by extending the stands relative to the pillars. A baby is loaded into the assembly by being placed on the support element and restrained by the restraints. The support element is released by releasing a brake 55 so that a suitable attitude may be selected. The carer may, if breastfeeding, place their legs under the support element. The brake 55 may be reapplied. The baby may be then breastfed.

When not feeding, the baby may simply lie on the support element 97 or in the second support element 71 or sit in the support element 71 if the keeper 24 has been mounted in the retainer blocks 27.

Steps to use of preferred embodiments include, when breastfeeding:

1. Load baby into restraint on support element.
2. Secure brake 55 so that it pulls tight on the sub-frame which secures the support element 97 tight.
3. Carer lifts the whole equipment and sits on a lounge or on a bed.
4. Carer makes herself comfortable in this position.
5. Carer then pulls the equipment as close to her as possible.
6. Carer loosens the brake slightly so that she can swivel the table to whatever angle she wishes.
7. Carer releases the restraint so that the baby is free.
8. Turns the baby on to the side and pulls the baby as close to her as she can and feeds the baby, while supporting the back of the baby giving the baby the same feeling as though the baby was being fed holding her in arms. What the invention is substituting is the lower arm that takes the load of the baby.

9. On finishing feeding on one side, carer levels the swivel table.
10. Carer turns the baby around on to the other side.
11. Carer swivels the table to the angle she desires.
12. Carer starts feeding the baby on the other side.
13. On completion of feeding the baby, carer levels the swivel bed.
14. Carer secures the baby with the aid of the restraint.
15. Carer tightens the brake to secure the support element.
16. Carer lifts the assembly 99 and put it aside.
17. Carer releases the restraint and takes the baby away.

Steps to follow in preferred embodiments when rocking:

1. Points 1-6 are the same as above for this procedure, i.e. secure the baby, get it on to the lounge, and loosen the brake.
2. Restraint for the baby can be released or left on.
3. There are two positions for the rocking motion.
4. Swivel the support element 97 to either flat or angle position.
5. Engage the lever so that the rack-locking block locks the rack into position with the support element 97.
6. Turn the motor on to start rocking motion.
7. Carer can also turn music on if its felt that it will help the baby settle.
8. On finishing, turn the motor and music off (if turned on).
9. Disengage the rack-locking block so that the rack is free to move.
10. Restrain the baby if released.
11. Lock the brake.
12. Put the table down and release the baby.

Steps for use as a change table:

1. Release the brake.
2. Level the bed to a flat position. Can use the rack gear-locking block if needed to assist in levelling the table.
3. Lock the brake.
4. Use assembly 99 as a baby change table.

Engaging the Rocking Motion for the Second Embodiment (FIGS. 9, 10)

The rocking motion is achieved with the help of a rocking motor (part 17) driven pinion gear (part 11) working in conjunction with a rack gear (part 12). First the Swivel table (part 1) is tilted to the position, which can be either flat or at an angle. Once in position, the locking lever (part 15) is pulled so that the rack gear-locking block (part 14) comes forward and locks the rack gear in position. The locking lever will be pulled until it drops in front of the restrictor block (this is a small cube that is an integral part of swivel table) making sure that the lever doesn't get disengaged. This engages the swivel table with the rack gear, hence engaging the system for rocking motion.

Generating Rocking Motion for the Second Embodiment (FIGS. 9, 10)

As the pinion gear (part 11) is always engaged with the rack gear (part 12), we only need to turn the rocking motor on (part 17) which is battery driven to get the motion. The pinion gear is designed such that only part of it has gear teeth. The rack gear has teeth on either sides of the block. So the teeth of the pinion gear work on one side of the rack giving the swivel table the forward motion. As the last teeth of the pinion gear gets released from the rack gear teeth on one side, the pinion gear teeth get engaged on the other side giving the swivel table its reverse motion. Hence the rocking motion is achieved. This motion can be achieved in two positions of the swivel table. One when it is flat so that the baby is lying down and getting the rocking movement, and the other with the swivel table at an angle (it can be angle in either directions).

Disengaging Rocking Motion for the Second Embodiment (FIGS. 9, 10)

The rocking motor (part 17) is turned off. The locking lever (part 15) is lifter up from the restricting block and pushed back to disengage the rack locking block (part 14). This free the rack gear (part 12) from the swivel table (part 1), thus disengaging the rocking motion.

Converting to Change Table (FIG. 2,3)

The hex nuts (part 7) are loosened releasing the T-bolts (part 6). This lets the swivel table to swivel freely on the rollers (part 16). Level the table to a flat position. This can be done by general eye comparison with the ground it is standing on or the rack gear can be engaged into the level position. Once this is done, the hex nuts are tightened up locking the swivel table movement.

It is contemplated to provided a removable cage system which is not shown but mounts on the support element 97 to retain the baby or protect it from pets and other potential dangers.

The foam on the support element 97 or the flexible hammock sheet 62 may be removable for cleaning.

A clamp may be provided (not shown) so that the assembly can be clamped onto a chair and easily swung. This is so that the equipment can be used in conjunction with a chair that is smaller than the width of the legs. On the contrary the pillars of the equipment can be eliminated and the chassis clamped on to arm of a chair.

The assembly and chassis may be disassembled for carrying in a bag.

The complete design of the swivel table can be changed and a hinged mechanism can be used to get the tilt action to the table on which the baby in going to be restrained.

A handle or handles or straps may be provided on the chassis for easy carrying when assembled.

Motion about other axis may be provided by mounting the assembly or support element 97 on pins.

Referring to FIGS. 11-15 there is shown a third embodiment of baby support 299 which has similar structural and functional aspects to the first and second embodiments described above. In the drawings, where possible, like parts are denoted by like numerals.

The support assembly 299 includes a chassis 298 and baby support element 297. The chassis 298 includes adjustable support stands 292 which may elevate the support element 297 when the telescoping pillars 293 are extended. The pillars 293 are locked in place at a selected height by fasteners 214. It can be seen that the support stands at either end and for that matter, the pillars at either side, allow for independent height adjustment with respect to the four corners (or at the very least, side-to-side and end-to-ends may be varied).

Chassis 298 includes a peripheral sub-frame element 270 which is tubular in construction. The frame element 270 is pivotally mounted on pivots 201 mounted in bores 291 on mounting blocks 202 which are disposed intermediate the ends of the frame so as to facilitate balanced pivoting. A rocking means 268 is provided, in the form of an electric motor 220 which rotates a cam 222. The cam 222 may have a flat section to allow a pause in the rocking motion, or a lock. A rocking lock 288 may be provided so as to fix the attitude of the baby support 297. In the embodiment shown the rocking lock 288 is in the form of an extension arm 289 which is mounted to the pivoting blocks 202. A pin 229 is inserted into aligned apertures at a level (or any other) attitude in order to lock the rocking motion.

The rocking motion is limited in the third embodiment by the mounting block 202 which has a cam element 272 on an upper face. When the support assembly 299 is assembled, the peripheral frame 270 sits on the upper face of the block 202. The arrangement of the rock limiter 275 is such that the frame, which is straight, rocks back and forth on a convex surface 273, which includes a top-hat section to enable a slightly extra free rocking portion of the rocking travel. When the frame 270 abuts the outer wings 271 of the convex surface, the frame softly comes to a gentle pause and then rocks back, because of the baby having most of its weight on one side of the support element 297.

Finally, it is to be understood that various alterations, modifications and/or additions may be incorporated into the various constructions and arrangements of parts without departing from the spirit or ambit of the invention.

I claim:

1. A support assembly for supporting a baby for ease of feeding, the support assembly including a chassis with supporting legs and a subframe carrying an elongate support element for holding a baby, wherein:

the supporting legs are spaced apart to accommodate a carer's legs there between;

the support element holds the baby in an end-to-end relation relative to the support element, whilst avoiding any crib fencing or other structure that would impede intimate contact between a carer adjacent an elongate side of the support element and the baby on the support element; and the subframe is coupled to the chassis to pivot about a transverse axis of the support element whereby to allow the support element to tilt relative to the chassis, such that the feet and head of the baby pivot simultaneously in opposite directions when the support element is tilted to thereby allow the baby's stomach to be positioned below its mouth, as required, for ease of feeding.

2. The support assembly in accordance with claim 1 wherein the supporting legs further include height adjustment elements adapted to vary the height of the chassis above the surface to accommodate the carer's thighs underneath the chassis; and wherein the pivotal coupling of the subframe to the chassis is independent of the height adjustment elements.

3. The support assembly of claim 2 wherein the pivotal coupling of the subframe to the chassis is configured to provide for a reciprocating rocking motion about the transverse axis in addition to the tilting of the support element about the transverse axis.

4. The support assembly in accordance with claim 2 wherein the height adjustment elements further includes telescoping portions of the legs for raising or lowering the height of the chassis relative to the surface.

5. The support assembly in accordance with claim 4 wherein a link means is provided between one or more legs, stands or pillars in order to provide uniform height adjustment across at least one pair of adjacent legs, stands or pillars.

6. The support assembly in accordance with claim 1 wherein the tiltability is enabled by one or more curved guides and cooperating followers provided between the chassis and support element.

7. The support assembly in accordance with claim 6 wherein a disengaging means is provided to disengage an electric motor, crankshaft, or conrod from the support element or chassis, in order to allow a rocking motion to be manually imparted to the support element.

8. The support assembly in accordance with claim 1 wherein mechanical, hydraulic, pneumatic or electrical means, or a combination of one or more of those means, provides motive force for adjusting tiltability of the support element.

9. The support assembly in accordance with claim 1 wherein a restraint device is operatively connected to the support element to restrain a baby when positioned on the support element.

10. The support assembly in accordance with claim 1 wherein the support element includes a detachable padded table, the padded table including individually detachable side bumpers which inhibit a baby rolling off the padded table.

11. The support assembly in accordance with claim 10 wherein the padded table is disposed, when installed, on a second support element, the second support element being a hammock bed.

12. The support assembly in accordance with claim 10 wherein a removable transverse strut is mounted at an intermediate location on the chassis so as to provide support for the padded table when installed.

13. The support assembly in accordance with claim 12 wherein a second mounting for the strut is provided to facilitate the formation of a seat for a larger or older child, and wherein the second mounting is disposed nearer to one end of the chassis, whereby, when the strut is installed, a form of bucket seat is provided.

14. The support assembly in accordance with claim 1 wherein mounting blocks are disposed intermediate each side of the chassis and the subframe is provided in the form of a flat tubular frame; and wherein the mounting blocks include pivots connecting the chassis and the subframe, the mounting blocks also including a convex upper surface that provides a cam; and wherein the subframe is seated on the cam such that the subframe is able to rock back and forth on the convex surface.

15. The support assembly in accordance claim 1 wherein the support element is in the form of a tabletop.

16. The support assembly in accordance with claim 1 wherein locking means are provided between the chassis and the support element to lock the support element at least one predetermined tilt angle relative to the chassis.

17. The support assembly in accordance with claim 1 wherein pivots are provided intermediate each side edge of the chassis for mounting the subframe to the chassis whereby to allow the subframe to tilt about the pivots.

18. The support assembly in accordance with claim 1 wherein means for altering the attitude of the support element includes an automatic rocking means for rocking the support element relative to the chassis.

19. The support assembly in accordance with claim 1 wherein the support element is either in the form of a hammock of a loose material bag supported at its perimeter, or in the form of a support bed having articulated platforms.

20. The support assembly in accordance with claim 19 wherein a rocking motion is imparted to the support element by a rotating cam driven by an electric motor, and which earn lifts a peripheral frame on one side of the pivots.

* * * * *